US005593025A

United States Patent [19]

Feibelman

[11] Patent Number: 5,593,025

[45] Date of Patent: Jan. 14, 1997

[54] FOLDABLE JEWELRY CARD

[75] Inventor: Jeffrey A. Feibelman, East Greenwich, R.I.

[73] Assignee: Display Technologies, Inc., Johnston, R.I.

[21] Appl. No.: 573,396

[22] Filed: Dec. 15, 1995

[51] Int. Cl.[6] ..... A45C 11/04

[52] U.S. Cl. ..... 206/6.1; 206/495; 206/756; 206/806

[58] Field of Search ..... 206/6.1, 756, 757, 206/486, 806, 495, 737, 762, 434, 807; 211/113, 73

[56] References Cited

U.S. PATENT DOCUMENTS

| | | | |
|---|---|---|---|
| 2,212,630 | 8/1940 | Anderson . | |
| 2,850,160 | 9/1958 | Siebel et al. | 206/806 X |
| 2,995,845 | 8/1961 | Fraser . | |
| 3,014,636 | 12/1961 | Fielding | 206/434 |
| 3,128,984 | 4/1964 | Palm | 211/73 X |
| 3,155,232 | 11/1964 | Leone | 206/486 X |
| 3,329,386 | 7/1967 | Rosen . | |
| 4,063,229 | 12/1977 | Welsh et al. | 206/807 X |
| 4,140,218 | 2/1979 | Forte . | |
| 4,503,975 | 3/1985 | Meyers et al. | 206/486 |
| 4,634,005 | 1/1987 | Kulzer et al. . | |
| 4,718,554 | 1/1988 | Barbato . | |
| 4,739,878 | 4/1988 | DiDomenico . | |
| 4,794,470 | 12/1988 | Lauffenburger et al. | 206/807 X |
| 4,887,709 | 12/1989 | Shimamine | 206/6.1 |
| 4,944,389 | 7/1990 | Robertson . | |
| 5,078,264 | 1/1992 | Garganese . | |
| 5,083,700 | 1/1992 | Mello et al. | 206/806 X |
| 5,251,756 | 10/1993 | Grange | 206/486 X |
| 5,390,794 | 2/1995 | Vulpitta . | |

*Primary Examiner*—Bryon P. Gehman
*Attorney, Agent, or Firm*—Salter & Michaelson

[57] ABSTRACT

A foldable jewelry card, capable of securing thereto an article or articles of jewelry, includes a front panel with a forwardly facing surface and a rearwardly facing surface. An intermediate panel is hingedly connected to the front panel, and interconnects the front panel with a rear panel hingedly connected thereto. The rear panel has a forwardly facing surface, a rearwardly facing surface, and a hook portion for supporting the card on a hanger. The rear panel and the front panel are attached to one another in such a manner that the front panel is securely interlocked with the rear panel. The intermediate panel causes the front and rear panels to be at an acute angle with each other whereby the forwardly facing surface of the rear panel substantially faces the rearwardly facing surface of the front panel.

8 Claims, 3 Drawing Sheets

FOLDABLE JEWELRY CARD

BACKGROUND AND SUMMARY OF THE INVENTION

This invention relates generally to cards used to hold jewelry, and more particularly to a foldable jewelry card which is capable of securing thereto an article of jewelry (e.g., an earring, necklace, or the like).

There are many different jewelry card designs for securing and displaying articles of jewelry (e.g., earrings, necklaces, etc.) to consumers. FIGS. 1 and 2 are indicative of two prior art jewelry cards in the field of the present invention. As illustrated in FIG. 1, a well-known prior art jewelry card, generally indicated at 10, has a front panel 12 and a rear panel 14 which is in abutting, parallel relation to the front panel 12 and attached thereto by suitable adhesive. Provided along the upper edge of the rear panel 14 is a hook portion 16 for attaching the card 10 to a suitable display or rack. The front and rear panels 12, 14 of the card 10 have aligned formations 18 having a plurality of openings which can receive articles of jewelry therethrough in the well-known manner. One significant disadvantage associated with this design is that the article of jewelry mounted thereto can be easily separated from the card 10 and stolen by shoplifters. When pierced earrings are attached to the card 10, for example, the clutches which axially slide onto the earrings' posts to attach the earrings to the card can be accessed and removed thereby enabling the shoplifter to easily remove the earrings from the card.

One solution to this problem is attempted in the foldable card generally indicated at 20 in FIG. 2. This card has a front wall 22, an interconnecting wall 24, and a rear wall 26. A handle portion 28 is integrally formed with the rear wall 26 and received through a slot 30 formed in the front wall 22. Thus, for pierced earrings which are attached to the front wall 22 of the card 20, the clutches of the earrings are disposed in the space between the front and rear walls 22, 24. However, a shortcoming of this design is that the handle portion 28 can be easily removed from the slot 30 thereby enabling a person to access and remove the clutches from the earring posts almost in the same manner as the card 10 illustrated in FIG. 1.

Reference can further be made to U.S. Pat. Nos. 2,212,630 to Anderson, 2,995,845 to Fraser, 3,329,386 to Rosen, 4,140,218 to Forte, 4,634,005 to Kulzer et al., 4,718,554 to Barbato, 4,739,878 to DiDomenico, 4,944,389 to Robertson, 5,078,264 to Garganese, and 5,390,794 to Vulpitta for other representative prior art. However, these patents are no more pertinent than the cards 10, 20 that are illustrated in FIGS. 1 and 2, respectively.

Accordingly, among the several objects of the present invention are the provision of an improved foldable jewelry card which is capable of mounting thereon pierced earrings wherein the clutches of the pierced earrings are substantially concealed and inaccessible for removal; the provision of such a jewelry card which is capable of substantially concealing a security device; the provision of such a jewelry card which can be supported by a J-bar, or standard display having a hanger, or on a flat surface, such as a table top; the provision of such a jewelry card which is capable of holding many types of jewelry, e.g., earrings, necklaces, pins and charms; the provision of such a jewelry card Which when hung has a front surface which is angled so as to display the jewelry mounted thereon at a better angle of presentation; the provision of such a jewelry card having a downwardly facing surface for receiving a price tag which is normally concealed from view by the consumer; and the provision of such a jewelry card which is simple to manufacture and easy to assemble.

In general, the present invention is directed to a foldable jewelry card capable of securing thereto an article or articles of jewelry. The card comprises a front panel with a forwardly facing surface and a rearwardly facing surface. The front panel has means for securing an article or articles of jewelry in a position in front of the forwardly facing surface. An intermediate panel is hingedly connected to the front panel, and interconnects the front panel with a rear panel hingedly connected thereto. The rear panel has a forwardly facing surface, a rearwardly facing surface, and means for supporting the card on a hanger. The rear panel and the front panel have means for attaching the rear panel to the front panel in such a manner that the front panel is positively interlocked with the rear panel to resist easy disconnection therebetween. The intermediate panel causes the front and rear panels to be at an acute angle with each other whereby the forwardly facing surface of the rear panel substantially faces the rearwardly facing surface of the front panel.

More specifically, the attaching means comprises a tab portion integrally formed along an upper edge of the front panel, and a slit formed in the rear panel. The tab portion is received within the slit of the rear panel for interlocking the front panel to the rear panel. The tab portion has a widthwise dimension greater than the widthwise dimension of the slit, and an arcuate upper edge terminating at a pair of oppositely positioned, inwardly extending notches which define a reduced neck section of the tab portion, the reduced neck section having a widthwise dimension less than the widthwise dimension of the slit.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENT

Figure 3:
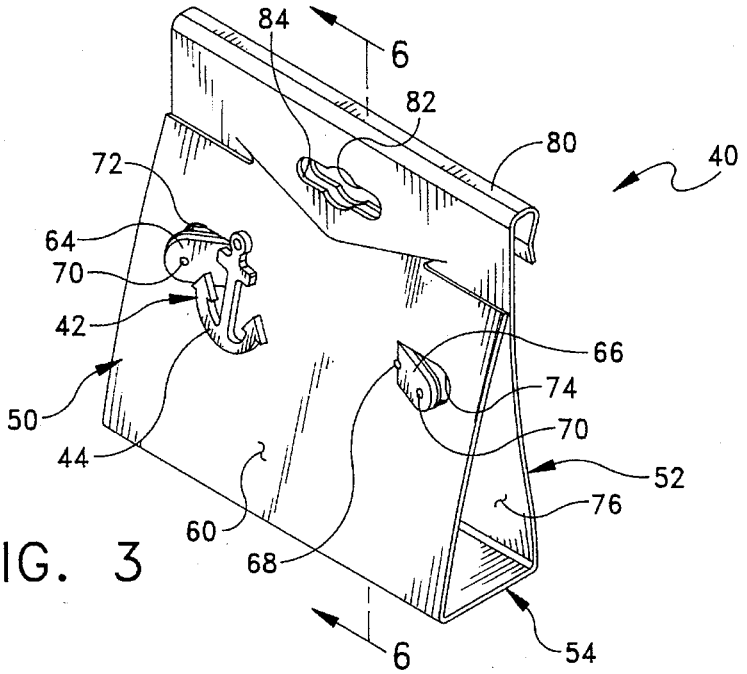
FIG. 3 is a perspective view of a foldable jewelry card of the present invention in a folded configuration.
Figure 4:
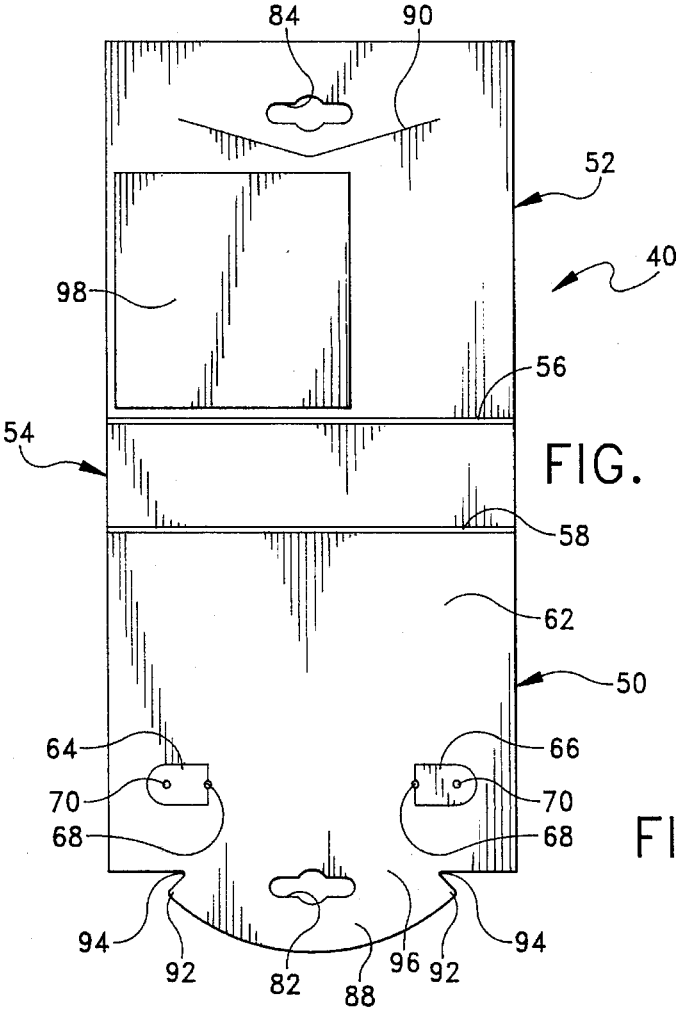
FIG. 4 is a front elevational view of the jewelry card in a pre-folded configuration.
Figure 5:
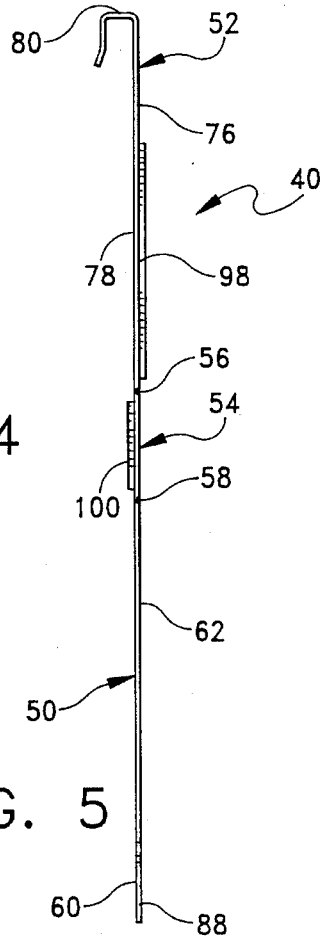
FIG. 5 is a right side elevational view thereof.
Figure 6:
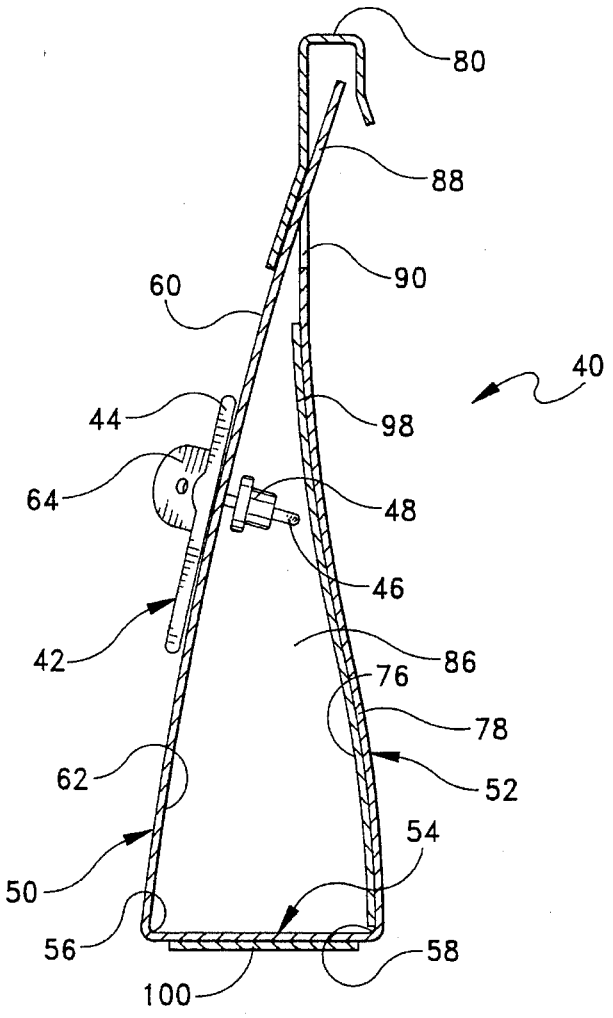
FIG. 6 is a cross-sectional view taken along line 6—6 in FIG. 3.

Referring now to the drawings, and more particularly FIGS. 3–7, there is generally indicated at 40 a foldable jewelry card which is capable of securing thereto an article of jewelry, such as the earring generally indicated at 42. As shown in FIGS. 3 and 6, the earring 42 is of the type having an ornament 44 (in the shape of an anchor) and a post 46 extending rearwardly from the ornament 44. The earring 42 further includes a clutch 48 which is received over the post 46 in the well-known manner. The jewelry card 40 of the present invention is especially suited for mounting the earring 42 thereon, and for concealing the clutch 48 so that a person would find it difficult to remove the clutch 48 (especially a locking clutch) from the card 40, and thereby difficult to remove the earring 42 from the card.

Figure 7:
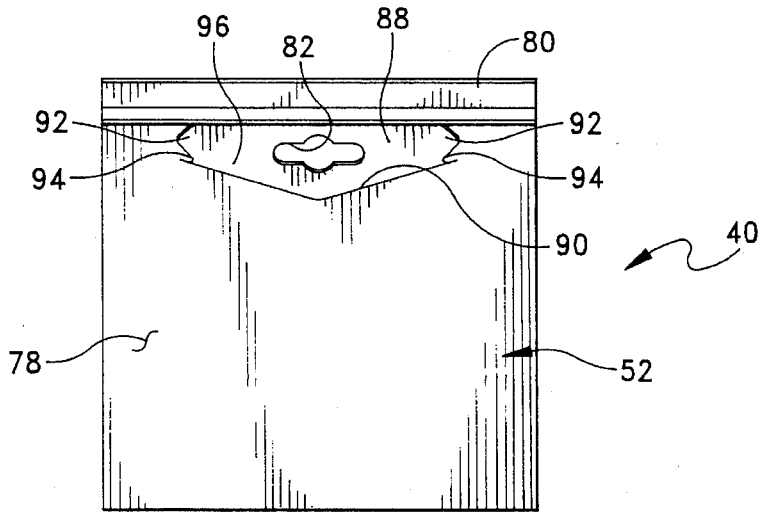
FIG. 7 is a rear elevational view of the jewelry card illustrated in FIG. 3.

The card 40, in FIGS. 3, 6 and 7, is depicted in its folded configuration, and in FIGS. 4 and 5, in its prefolded configuration. The card is preferably fabricated from any suitable rigid plastic material, and die cut to comprise a front panel, generally indicated at 50, a rear panel, generally indicated at 52, and an intermediate panel, generally indicated at 54, which interconnects the front and rear panels 50, 52. As shown in FIGS. 4 and 5, the front panel 50 is hingedly connected to the intermediate panel 54 along its lower edge. A fold line 56 is provided for facilitating the folding action of the front panel 50 relative to the intermediate panel 54. Turning to FIG. 5, it will be noted that the material comprising the fold line 50 is scored so as to further facilitate the folding action. Similarly, the rear panel 52 is hingedly connected to the intermediate panel 54 along its upper edge, there being provided another fold line 58 for facilitating the folding action of the rear panel 52 relative to the intermediate panel 54.

In its folded configuration, the front panel 50 is provided with a forwardly facing surface 60 and an oppositely facing rearwardly facing surface 62. The front panel 50 further is provided with means embodying a pair of cut-out flaps 64, 66 for securing the earring 42 in a position in front of the forwardly facing surface 60. As shown, each flap 64, 66 has a pair of openings 68, 70 formed therein which are adapted to receive posts of earrings therethrough. The flaps 64, 66 can also accommodate a necklace (not shown) whereby the majority of the length of the necklace is disposed behind the front panel 50 and is threaded through the cut-out openings 72, 74 formed by the flaps 64, 66 for displaying a pendent or some other article of jewelry attached to the necklace. This construction is well-known in the art of jewelry cards.

Figure 1:
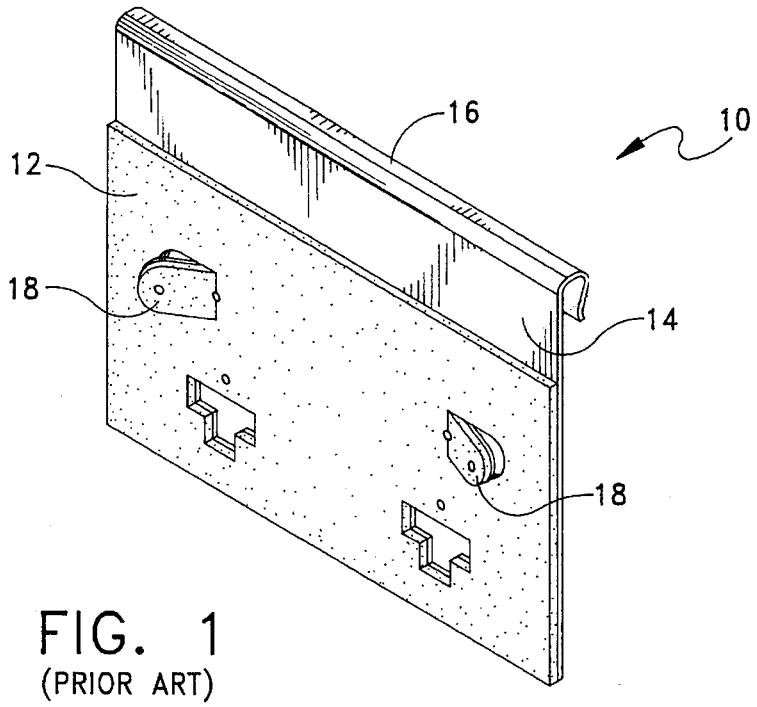
FIG. 1 (PRIOR ART)
FIG. 1 is a perspective view of a prior art jewelry card.
Figure 2:
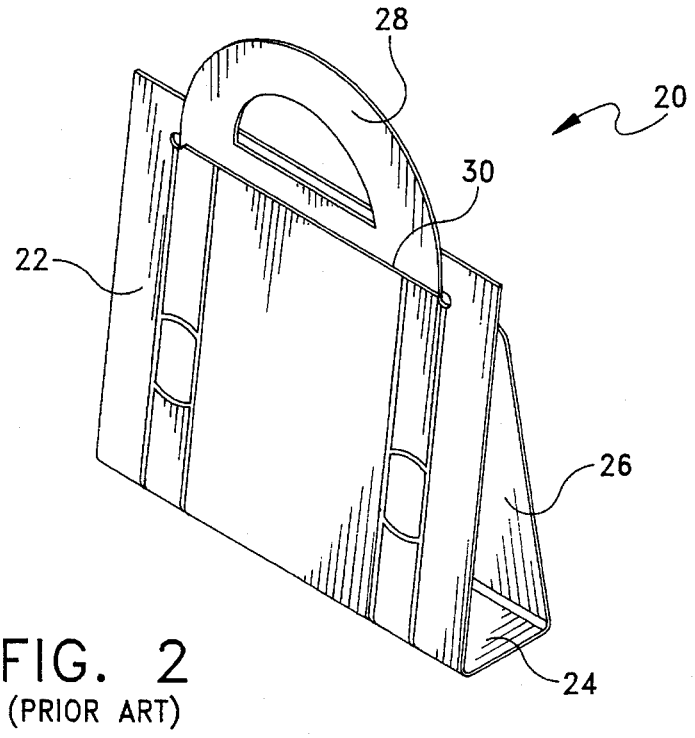
FIG. 2 (PRIOR ART)
FIG. 2 is a perspective view of another prior art jewelry card.

The rear panel 52 also has a forwardly facing surface 76 and an oppositely facing rearwardly facing surface 78. For supporting the card on a J-bar, for example, the rear panel 52 is further provided with a hook portion 80 integrally formed along the upper edge of the rear panel 52. This hook portion 80 can be broadly referred to as "support means". The hook portion 80 functions identically as the hook portion 16 of the card 10 represented in FIG. 1. The front and rear panels 50, 52 also have a pair of aligned, elongate apertures 82, 84 respectively, formed therein for attaching the card 40 to a hanger (not shown) in the well-known manner. One advantage, however, of the card 40 of the present invention over card 10 is that, when hung on hanger, 82 the plane of the aperture 82 of the front panel 50 is angled relative to the plane of the aperture 84 of the rear panel 52 thereby providing some friction when slipping the card 40 over a hanger. This friction helps prevent the card 40 from sliding off the hanger.

The front panel 50 is attached to the rear panel 52 in such a manner that the front panel 50 is interlocked with the rear panel 50. More specifically, as illustrated in FIG. 6, the intermediate panel 54 causes the front and rear panels to be at an acute angle with each other whereby the forwardly facing surface 76 of the rear panel 52 substantially faces the rearwardly facing surface 62 of the front panel 50. This angle creates a narrow space 86 (see FIG. 6) through which the post 46 of the earring 42 extends and the clutch 48 of the earring 42 is located. Thus, it should be pointed out that the card 40, when in its folded configuration of FIGS. 3, 6 and 7, can conceal the clutch 48 of the earring 42 thereby making it difficult to remove the clutch and thus the earring.

The attaching means of the present invention is embodied in a tab portion 88 integrally formed along the upper edge of the front panel 50, and a slit 90 formed in the rear panel 52. As illustrated in FIG. 6, the tab portion 88 is received within the slit 90 of the rear panel 52 for interlocking the front panel 50 to the rear panel 52. For achieving this interlocking relationship, the tab portion 88 has a widthwise dimension slightly greater than the widthwise dimension of the slit 90 so that when the tab portion 88 is inserted into the slit 90, end elements 92 of the tab portion extend outwardly beyond the peripheral ends of the slit 90 thereby retaining the tab portion 88 to the rear panel 52. The tab portion 88 has an arcuate upper edge, and the end elements 92 are created by forming a pair of oppositely positioned, inwardly extending notches 94 which further define a reduced neck section 96 of the tab portion 88. The reduced neck section 96 has a narrower widthwise dimension than the widthwise dimension of the slit 90. Preferably the slit 90 is V-shaped for further securing the tab portion 88 to the rear panel 52 since the shape of the slit deforms the tab portion.

It should further be noted that when in its folded condition, the tab portion 88 extends through the slit 90 from the front surface 76 to rear surface 78 of the rear panel 52. As shown, the hook portion 80 substantially conceals the tab portion 88 when it is interlocked with the rear panel 52. This arrangement provides a nice, clean surface 60 for displaying jewelry and also hides the tab portion 88.

As shown in FIG. 3, when hanging the card on a J-bar or hanger, the rear panel 52 is substantially vertical. This causes the front panel 50 to be angled more towards the viewer of the card 40 thereby giving it a better angle of presentation for displaying the jewelry mounted thereon.

A security device 98 is fixedly attached to the forwardly facing surface 76 of the rear panel 52 in the manner illustrated in 4–6. The security device 98 is preferably a thin, circuit element which may be energized upon passing through a conventional store theft detector. Since the security device 98 is located within the space 86 between the front and rear panels 50, 52, it is somewhat concealed and thus tamper resistant. Prior art cards have, for the most part, insufficient space upon which to mount a security device. Moreover, since the front panel 50 is interposed between the security device 98 and the ornament 44 of the earring 42, the metal content of the ornament 44 will not interfere with the operation of the security device 98.

Preferably, a price tag or label 100 is applied to the downwardly facing surface of the intermediate panel 54 for indicating the type of article of jewelry, what it is made from, and its price, for example. The location of the label 100 is in an unobtrusive area and does not detract from the overall appearance of the jewelry card 40.

It should be noted that the rigid nature of the plastic from which the card 40 is fabricated substantially prevents the tab portion 88 from being easily removed from the slit 90 after its insertion. Only after applying a significant amount of force, can the tab portion 88 be removed therefrom. By making it more difficult to disassemble the card 40, the likelihood of theft of the articles of jewelry attached to the card 40 is reduced. It should be further noted that the card 40 can be supported either by a J-bar or a hanger. The card 40 can also rest upon a horizontal surface upon its intermediate panel 54.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A foldable jewelry card for securing thereto at least one article of jewelry comprising:

a front panel having a lower edge, an upper edge, a forwardly facing surface and a rearwardly facing surface, said front panel further having means for securing at least one article of jewelry in a position in front of the forwardly facing surface, and a tab portion formed along the upper edge, said tab portion having a pair of oppositely positioned, end elements that taper inwardly to form notches which define a reduced neck section of the tab portion;

an intermediate panel hingedly connected to the front panel along the lower edge of the front panel; and a rear panel having a lower edge hingedly connected to the intermediate panel, an upper edge, a forwardly facing surface, a rearwardly facing surface, and means for supporting said card on a hanger, said rear panel further having a slit formed therein, said slit extending in a widthwise dimension generally parallel to the widthwise dimension of the card, wherein said tab portion is received within the slit of the rear panel in-such a manner that the tab portion extends from the forwardly facing surface of the rear panel to the rearwardly facing surface thereof, said slit having a widthwise dimension slightly greater than the widthwise dimension of the reduced neck portion and less than the widthwise dimension of said end elements for interlocking the front panel to the rear panel.

2. A foldable jewelry card as set forth in claim 1, said tab portion having an arcuately-shaped upper edge.

3. A foldable jewelry card as set forth in claim 2, said slit being V-shaped.

4. A foldable jewelry card as set forth in claim 1 further comprising a security device fixedly attached to the forwardly facing surface of the rear panel.

5. A foldable jewelry card as set forth in claims 1, said supporting means comprising a hook portion integrally formed along an upper edge of the rear panel.

6. A foldable jewelry card as set forth in claim 1, said supporting means comprising a pair of aligned, elongate apertures formed in the front and rear panels.

7. A foldable jewelry card comprising:

a front panel having a lower edge, an upper edge, a forwardly facing surface, a rearwardly facing surface, means for securing at least one article of jewelry in a position in front of the forwardly facing surface, and a tab portion formed along the upper edge;

an intermediate panel hingedly connected to the front panel along the lower edge of the front panel; and a rear panel having a lower edge hingedly connected to the intermediate panel, an upper edge, a forwardly facing surface, a rearwardly facing surface, means for supporting said card on a hanger, a slit formed therein, said slit extending in a widthwise dimension generally parallel to the widthwise dimension of the card, and a rearwardly projecting hook portion integrally formed along an upper edge of the rear panel along the width of the card, wherein said tab portion is received within the slit of the rear panel in such a manner that the tab portion extends from the forwardly facing surface of the rear panel to the rearwardly facing surface thereof and is received within said hook portion so as to be concealed thereby.

8. A foldable jewelry card for securing thereto at least one article of jewelry comprising:

a front panel having a lower edge, an upper edge, a forwardly facing surface and a rearwardly facing surface, said front panel further having means for securing at least one article of jewelry in a position in front of the forwardly facing surface, and a tab portion formed along the upper edge;

an intermediate panel hingedly connected to the front panel along the lower edge of the front panel; and a rear panel having a lower edge hingedly connected to the intermediate panel, an upper edge, a forwardly facing surface, a rearwardly facing surface, and means for supporting said card on a hanger, said rear panel further having a slit formed therein, said slit extending in a widthwise dimension generally parallel to the widthwise dimension of the card, wherein said tab portion is received within the slit of the rear panel in such a manner that the tab portion extends from the forwardly facing surface of the rear panel to the rearwardly facing surface thereof.

* * * * *